US008436539B2

(12) United States Patent
Haacke et al.

(10) Patent No.: US 8,436,539 B2
(45) Date of Patent: May 7, 2013

(54) THORIUM-FREE DISCHARGE LAMP WITH REDUCED HALIDES AND INCREASED RELATIVE AMOUNT OF SC

(75) Inventors: Michael Haacke, Aachen (DE); Norbert Lesch, Vaals (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 181 days.

(21) Appl. No.: 12/678,532

(22) PCT Filed: Sep. 19, 2008

(86) PCT No.: PCT/IB2008/053807

§ 371 (c)(1), (2), (4) Date: Mar. 17, 2010

(87) PCT Pub. No.: WO2009/040709

PCT Pub. Date: Apr. 2, 2009

(65) Prior Publication Data

US 2010/0213807 A1 Aug. 26, 2010

(30) Foreign Application Priority Data

Sep. 24, 2007 (EP) ..... 07117047

(51) Int. Cl.

*H01J 61/12* (2006.01)
*H01J 61/30* (2006.01)
*H01J 17/20* (2006.01)

(52) U.S. Cl.

USPC ..... 313/638; 313/637; 313/633; 313/640; 313/643

(58) Field of Classification Search ..... 313/633, 313/637, 638

See application file for complete search history.

(56) References Cited

U.S. PATENT DOCUMENTS

| | | | | |
|---|---|---|---|---|
| 4,967,330 | A | 10/1990 | Bell et al. | |
| 5,471,110 | A | 11/1995 | Van Der Leeuw et al. | |
| 6,614,103 | B1 | 9/2003 | Durocher et al. | |
| 7,126,281 | B2 * | 10/2006 | Grundmann et al. | 313/637 |
| 2002/0122309 | A1 | 9/2002 | Abdelhafez et al. | |
| 2003/0189408 | A1 | 10/2003 | Lapotovich | |
| 2004/0100204 | A1 | 5/2004 | Chun | |
| 2004/0105264 | A1 | 6/2004 | Spero | |
| 2006/0049761 | A1 * | 3/2006 | Almanstotter et al. | 313/631 |
| 2007/0182332 | A1 * | 8/2007 | Haacke et al. | 313/633 |
| 2008/0093992 | A1 * | 4/2008 | Lesch et al. | 313/624 |

FOREIGN PATENT DOCUMENTS

| | | | |
|---|---|---|---|
| EP | 1063681 | A | 12/2000 |
| EP | 1349197 | A2 | 10/2003 |
| EP | 1465237 | A1 | 10/2004 |
| EP | 1526564 | B1 | 4/2005 |
| WO | WO02078051 | A1 | 10/2002 |
| WO | WO03060947 | A | 7/2003 |
| WO | WO2006043184 | A | 4/2006 |
| WO | WO2007026288 | A | 3/2007 |

* cited by examiner

*Primary Examiner* — Sikha Roy

(57) ABSTRACT

A high-pressure gas discharge lamp has a sealed discharge vessel with an inner discharge space. Two electrodes project into the discharge space. The filling in the discharge space includes metal halides and a rare gas. The filling is free of Hg and Th and includes halides in an amount of 7.1-11.4 μg/mm$^3$ of the volume of the discharge space. The halides includes at least NaI and $ScI_3$, provided in such amounts that a ratio of the masses of NaI to $ScI_3$ is 1.2-1.6.

13 Claims, 4 Drawing Sheets

THORIUM-FREE DISCHARGE LAMP WITH REDUCED HALIDES AND INCREASED RELATIVE AMOUNT OF SC

FIELD OF THE INVENTION

The present invention relates to a high-pressure gas discharge lamp, in particular for use in automotive front lighting.

BACKGROUND OF THE INVENTION

A high-pressure gas discharge lamp comprises a sealed discharge vessel with an inner discharge space. Two electrodes project into the discharge space, arranged at a distance from each other, to ignite an arc therebetween. The discharge space has a filling comprising a rare gas and further ingredients such as metal halides. Discharge lamps are used in the automotive field due to their high efficiency and good radiating properties. While many discharge lamps used for automotive front lighting contain mercury, lately, mercury-free lamp designs have been proposed for environmental reasons.

However, besides mercury, also thorium is present in discharge lamps. On one hand, thorium may be present in the salts contained in the lamp filling, e.g. as thorium-iodide. On the other hand, thorium is commonly present as thorium oxide in tungsten electrodes.

EP-A-1349197 describes a mercury free metal halide lamp for use in an automotive headlight. In order to achieve an enhanced luminous efficiency, a low lamp voltage reduction, light with a chromaticity suitable for an automotive headlamp, and an increased, rapidly rising luminous flux, the amount of first halides containing a scandium halide (mass a) and a sodium halide (mass b) are chosen such that $0.25<a/(a+b)<0.8$ and preferably $0.27<a/(a+b)<0.37$. A second halide (mass c) is present for providing a lamp voltage in place of mercury in an amount such that $0.01<c/(a+b+c)<0.4$, and preferably $0.22<c/(a+b+c)<0.33$. The halides are present in the discharge vessel in an amount of 0.005-0.03, preferably 0.005-0.02 mg/mm3 of the inner volume. Additionally, Xenon gas is present in the discharge medium at 5-20 atmospheres cold pressure. Rod-shaped electrodes are provided with a shaft diameter of 0.3 mm or more which may be made of tungsten, doped tungsten, rhenium, a rhenium/tungsten alloy or the like. An outer envelope houses the discharge vessel, which may be hermetically sealed from the outside air or may have air or an inert gas at an atmospheric or reduced pressure sealed therein. In an example, tungsten electrodes of 0.35 mm diameter are provided in a discharge vessel of 34 mm3. The discharge medium contains 0.1 mg of ScI3, 0.2 mg of NaI and 0.1 mg of ZnI2 with Xe gas at 10 atm at 25° C. In a first comparative example with a higher amount of the second halide the amount of halides are 0.08 mg ScI3, 0.42 mg NaI and 0.30 mg ZnI2. In a second comparative example the amount of halides are 0.1 mg $ScI_3$, 0.5 mg NaI and 0.2 mg $ZnI_2$.

SUMMARY OF THE INVENTION

Lamps for use in the automotive field have to comply with certain requirements. Besides the run-up properties (amount of light delivered shortly after ignition of the lamp as well as possible electromagnetic emissions after ignition) and steady-state requirements such as a high luminous flux and specified color this concerns lifetime properties such as lumen maintenance (limited loss of light output in long-term use), limited lamp voltage increase and limited color shift.

It is an object of the present invention to provide a lamp with good environmental properties, yet suited for automotive use.

The inventors have recognized that simply removing thorium both from the lamp filling and the electrode material of known lamp designs will not lead to a lamp fulfilling automotive requirements. Thus, additionally to removing thorium from the lamp, the invention proposes special measures with regard to the filling within the discharge space which have surprisingly shown to lead to lamp designs with good lifetime behavior.

According to the invention, halides are provided within the filling in a tightly specified amount, which is significantly reduced with the regard to prior designs. The filling contains halides in an amount of 7.1-11.4 $\mu g/mm^3$ of the volume of the discharge space. The halides comprise at least NaI and $ScI_3$, which are provided with a ratio of their masses 1.2-1.6.

If a lamp is designed simply starting from a known lamp design and eliminating ThO within the electrode material, the resulting Th-free lamps have been found to suffer from severe disadvantages, such as decreased lumen maintenance and flicker.

The specific choice of filling addresses the problems associated with eliminating thorium both from the filling and the electrode material of a discharge lamp. Within the electrode material, thorium (or, more specifically, $ThO_2$) serves in its property as a solid state emitter to lower the work function of the electrode. Thus, in operation at electrically comparable parameters, an electrode without ThO will have a higher temperature. Electrode burn-back will increase. Due to the then reduced electrode length, more heat will be transferred to the discharge vessel material, e.g. quartz glass, leading to adverse lifetime behavior.

The inventors have recognized that the problems of Th-free lamps, specifically decreased lumen maintenance, are caused by different temperature behavior of the Th-free lamp as compared to prior designs. The inventors believe the observed low lumen maintenance to be caused by chemical reactions of the Sc component within the filling occurring at the elevated temperatures.

To counter this effect, it has surprisingly proven successful to limit the salt filling to a relatively small amount, but at the same time increase the relative amount of Sc within the filling. By providing an overall lower amount of halides, also the critical Sc amount is reduced. However, the amount of halides must not be reduced too much to avoid excessive color shift.

On the other hand, a reduced amount of halides alone would result in a limited luminous flux. Thus, the composition of the halides is changed to increase the proportion of Sc as a chief light-generating component. However, again the amount of Sc cannot be increased arbitrarily, because a too high amount of Sc would lead to light of a color no longer suited for automotive head lighting.

Thus, with the above measures, the amount of the critical component Sc has been on one hand reduced (by providing a reduced amount of halides), and on the other hand increased (by limiting the $NaI/ScI_3$ ratio). While it could be expected that these two opposite measures would neutralize, and that the resulting lamp would suffer from the known lumen maintenance problems, it has surprisingly be found that the proposed measures lead to a lamp with an excellent lumen maintenance, and still fulfill the remaining requirements for automotive head lighting.

According to a further development of the invention, the amount of halides within the filling is further specified to be 8.5-10.5 $\mu g/mm^3$ of the volume of the discharge space. Also, the $NaI/ScI_3$ mass ratio is most preferably 1.3-1.4. Within these intervals, the properties of the lamp with regard to lumen output and lumen maintenance have been found to be optimal.

According to a further development of the invention, the halides within the filling further comprise $ZnI_2$, provided mainly for achieving a desired lamp voltage, which may initially be in the interval of 39-45 V. The amount of $ZnI_2$ may be chosen e.g. in the interval 0-20 wt-% of the halides, mostly depending on required electrical properties (voltage). Preferably it is proposed to be 4-12 wt-%, most preferably 6-10 wt-% of the halides. This has been found to limit the lamp voltage increase over the lifetime, especially if a rare gas is present at a cold pressure of no more than 17 bar. In this case it is possible that 60 V are only reached after more than 2000 hours.

As a further component, the halides preferably comprise InI, most preferably in an amount of 0.12-0.25 wt-% of the halides. Most preferably, the halides only consist of NaI, $ScI_3$, $ZnI_2$ and InI.

In a preferred embodiment of the invention the volume of the discharge space is 10-45 $mm^3$, especially preferred 19-25 $mm^3$. The invention could be applied to many different types of lamps to provide Th-free designs with excellent lifetime behavior. Such lamps will typically have a quartz glass discharge vessel and may be designed for 20-45 W. Especially preferred are automotive lamps with e.g. 35±3 W, which further fulfill the R99 regulations.

A rare gas provided in the filling is preferably xenon, which may be present at a cold pressure of 11-17 bar. A pressure of 13-15 bar is especially preferred.

The electrodes are preferably made of tungsten. Generally, they could be of any shape, including stepped electrodes, or electrodes which—especially for large diameters—have a structure in the region embedded in the quartz material, such as coiled electrodes or laser treated electrodes. In a preferred embodiment, they are simply rod-shaped (i.e. pieces of drawn wire). A rod diameter of 280-320 μm is preferred, which is especially applicable for preferred wattages of 35±3 W. For strongly differing operating powers the diameter may need to be adjusted.

Further developments of the invention relate to an outer envelope provided around the discharge vessel. The outer envelope is preferably sealed and filled with a gas to provide well-defined thermal properties. Most preferably, the outer envelope is filled with a gas having a thermal conductivity of 60-90 mW/m*K at 800° C. This property may be achieved, as will become apparent in connection with the preferred embodiment, by choosing an appropriate combination of a gas filling material and pressure.

BRIEF DESCRIPTION OF THE DRAWINGS

The above and other objects, features and advantages of the present invention will become apparent from the following description of preferred embodiments, in which.

DETAILED DESCRIPTION OF EMBODIMENTS

Figure 1:
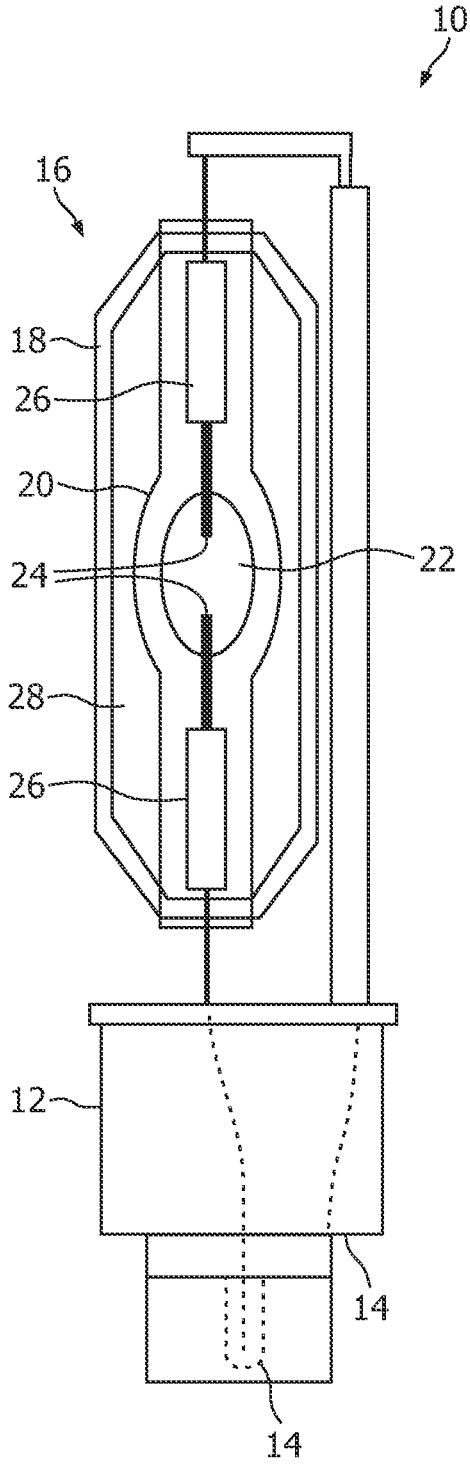
FIG. 1 shows a side view of a lamp according to an embodiment of the invention.

FIG. 1 shows a side view of an embodiment 10 of a discharge lamp. The lamp comprises a socket 12 with two electrical contacts 14 which are internally connected to a burner 16.

The burner 16 is comprised of an outer bulb 18 of quartz glass surrounding a discharge vessel 20. The discharge vessel 20 is also made of quartz glass and defines an inner discharge space 22 with projecting electrodes 24. The glass material from the discharge vessel further extends in longitudinal direction of the lamp 10 to seal the electrical connections to the electrodes 24 which comprise a flat molybdenum foil 26.

The outer bulb 18 is arranged around the discharge vessel 20 at a distance, thus defining an outer bulb space 28. The outer bulb space 28 is sealed.

The discharge vessel 20 has an outer wall arranged around the discharge space 22. The discharge space 22 is of ellipsoid shape. Also, the outer shape of the outer wall is ellipsoid.

The discharge vessel 20 is characterized by an electrode distance d, and a volume V of the discharge space.

The lamp 10 is operated, as conventional for a discharge lamp, by igniting an arc discharge between the electrodes 24. Light generation is greatly influenced by the filling comprised within the discharge space 22, which is free of mercury and includes metal halides as well as a rare gas.

The discharge vessel 20 of the lamp 10 has a wall thickness of 1.85 mm. The discharge space 22 has a length (rim distance) of 8 mm and a central inner diameter of 2.4 mm. The volume of the discharge space 22 is 21 $mm^3$.

The electrodes 24 are rod-shaped electrodes of pure tungsten material, and are free of Th. Alternatively, the material may be tungsten with dopants such as Al, Si and/or K. The rod electrodes have a diameter of 300 μm. The electrode distance is 3.7 mm (x-ray), such that the length of each of the electrodes 24 projecting into the discharge space 22 is around 2.15 mm.

The outer bulb 18 serves to control heat transfer during operation of the discharge vessel 20 to the outside. The outer bulb 18 is sealed and filled with a filling gas. The filling is chosen to achieve a heat conductivity (to be measured at 800° C.) within a range of 60 to 90 mW/m*K, preferably 68-76 mW/m*K. This heat conductivity may be achieved e.g. by a oxygen (68 mW/n*K) or air (76 mW/m*K) filling in the outer bulb, which both already have a suitable conductivity in the specified range, or alternatively by a filling combining gas of higher conductivity (such as, e.g. neon at 110 mW/m*K) with gas of lower conductivity such as, e.g. argon at 45 mW/m*K. Generally a pressure of the gas filling in the outer bulb 18 is preferably in the range of 10 mbar-2 bar, most preferably 30-200 mbar.

The outer bulb is essentially cylindrical, with a distance between the inner walls of the outer bulb 18 and the outer surface of the discharge vessel 20 of around 0.3 mm measured in a transversal plane arranged centrally between the electrodes 24.

In the following, examples of lamp fillings will be given.

FIRST, PREFERRED EXAMPLE

In the first example, the filling within the discharge vessel 22 of the lamp described above provided as follows:

| | |
|---|---|
| amount of halides | 200 μg |
| amount of halides per $mm^3$ of the discharge space 22 | 9.52 μg/$mm^3$ |
| mass ratio NaI/$ScI_3$ | 1.35 |
| $ZnI_2$ proportion | 8 wt-% |
| composition of halides | 105.5 μg NaI, 78.2 μg $ScI_3$, 0.3 μg InI, 16 μg $ZnI_2$ |
| rare gas filling | xenon at 14 bar (cold pressure) |

SECOND EXAMPLE

In the second example, the filling within the discharge vessel 22 of the lamp described above is provided as follows:

| | |
|---|---|
| amount of halides | 220 μg |
| amount of halides per $mm^3$ of the discharge space 22 | 10.48 $\mu g/mm^3$ |
| mass ratio $NaI/ScI_3$ | 1.39 |
| $ZnI_2$ proportion | 10 wt-% |
| composition of halides | 115 mg NaI, 82.6 mg $ScI_3$, 0.4 mg InI, 22 mg $ZnI_2$ |
| rare gas filling | xenon at 15.1 bar (cold pressure) |

Lamp Properties

Figure 2:
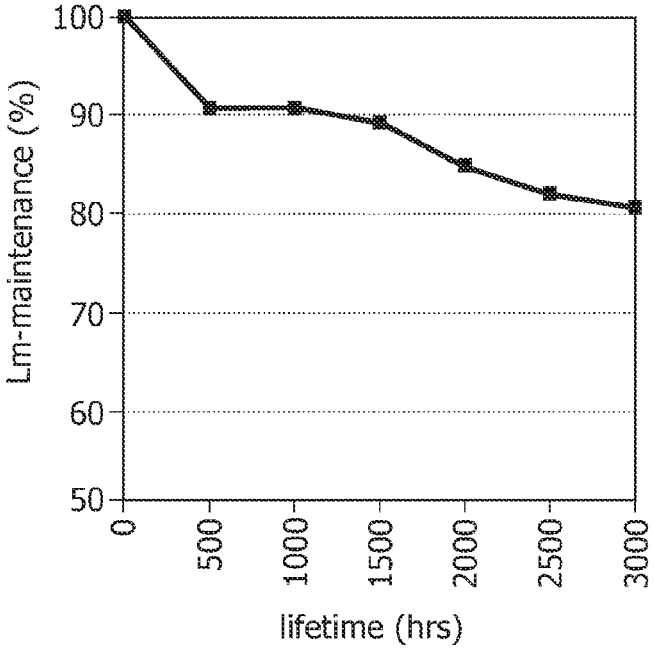
FIG. 2 shows a graph representing lumen maintenance over lifetime for a first embodiment.

FIG. 2 shows the lumen maintenance for the above first example. As shown, the lumen maintenance is significantly above specifications by automotive manufactures.

Figure 3:
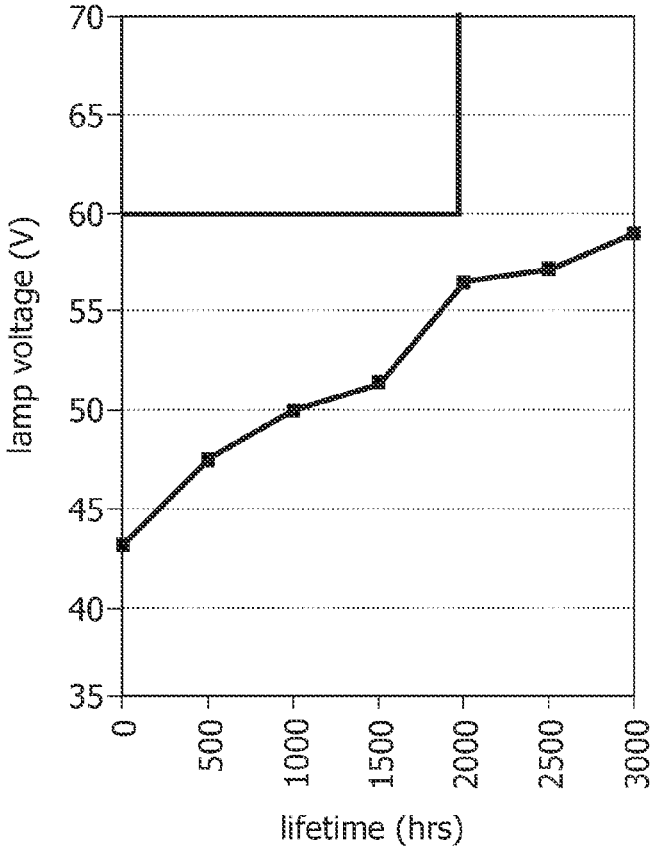
FIG. 3 shows a graph representing lamp voltage over lifetime for a first embodiment.
Figure 4A:
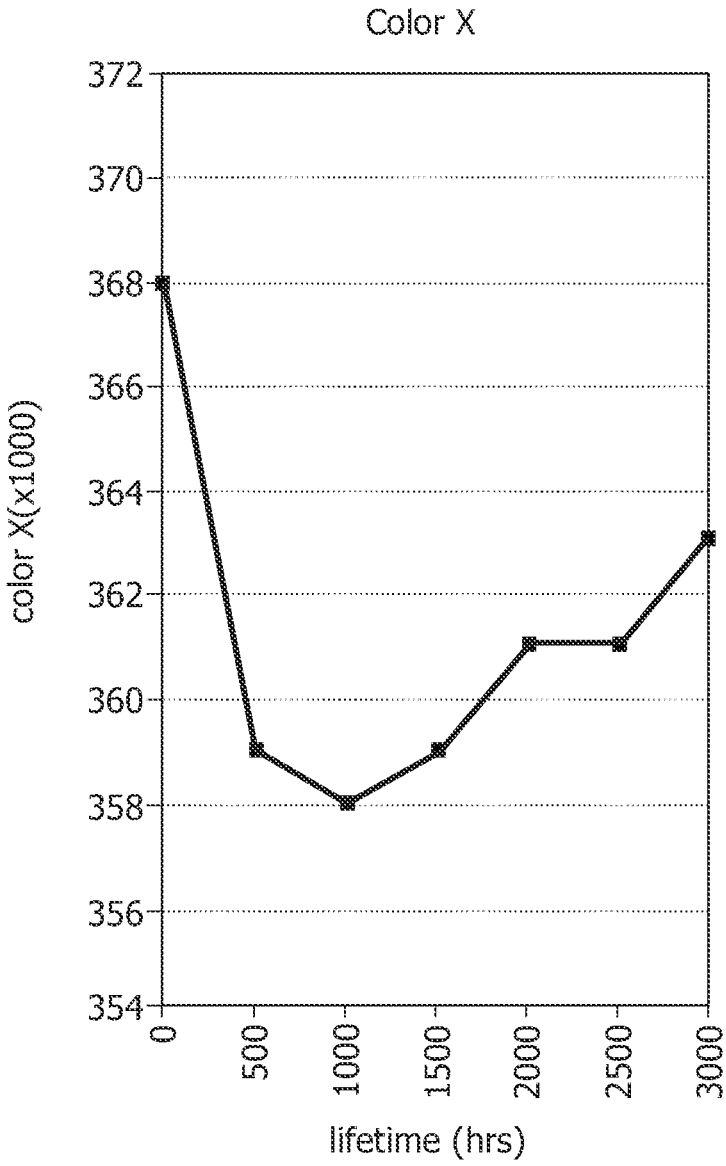
FIG. 4*a*, 4*b* show a graph representing color shift over lifetime for a first embodiment.
Figure 4B:
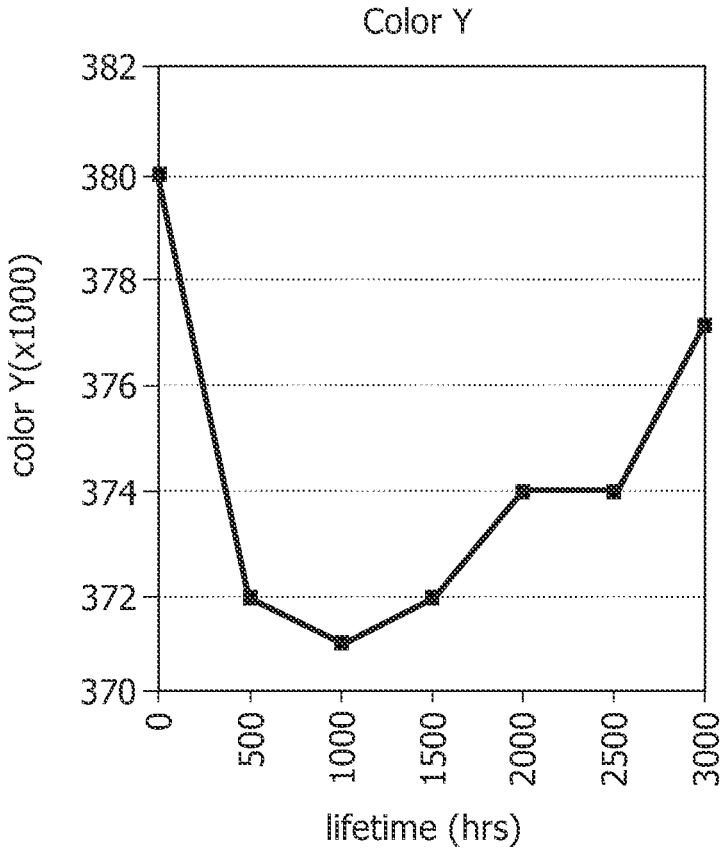

Also, as shown in FIG. 3, the increase in lamp voltage over lifetime is limited, such that a limit of 60 V is not exceeded within a lifetime of 2000 hours. The color shift X (FIG. 4*a*) and Y (FIG. 4*b*) for the example is also well-confined within acceptable bounds.

Thus, lamp designs have been shown for environmentally compatible Th-free and Hg-free lamps, which have a good lumen maintenance and fulfill all further requirements for automotive front lighting.

The invention has been illustrated and described in detail in the drawings and foregoing description. Such illustration and description are to be considered illustrative or exemplary and not restrictive; the invention is not limited to the disclosed embodiments.

In the claims, the word "comprising" does not exclude other elements, and the indefinite article "a" or "an" does not exclude a plurality. The mere fact that certain measures are recited in mutually different dependent claims does not indicate that a combination of these measures cannot be used to advantage. Any reference signs in the claims should not be construed as limiting the scope.

The invention claimed is:

1. A discharge lamp comprising:

a sealed discharge vessel defining a discharge space having a volume and comprising a filling including metal halides and a rare gas and being free of Hg and Th;

at least two electrodes projecting into said discharge space, said electrodes being free of Th, wherein said metal halides are provided in an amount of 7.1-11.4 $\mu g/mm^3$ of the volume of said discharge space and comprise NaI and $ScI_3$ in such amounts that a ratio of masses of NaI to $ScI_3$ is 1.2-1.6.

2. The discharge lamp of claim 1, wherein said metal halides further comprise at least InI.

3. The discharge lamp of claim 1, where wherein said metal halides consist essentially of NaI, $ScI_3$, $ZnI_2$ and InI.

4. The discharge lamp of claim 1, wherein said metal halides are provided in an amount of 8.5-10.5 $\mu g/mm^3$ of the volume of said discharge space.

5. The discharge lamp of claim 1, wherein the volume of said discharge space is 10-45 $mm^3$.

6. The discharge lamp of claim 1, wherein the volume is 19-25 $mm^3$.

7. The discharge lamp of claim 1, wherein the ratio of the masses of NaI to $ScI_3$ is 1.3-1.4.

8. The discharge lamp of claim 1, further comprising an outer envelope disposed around said discharge vessel, wherein said outer envelope is sealed and filled with a gas.

9. The discharge lamp of claim 8, wherein said outer envelope is filled with a gas having a thermal conductivity of 60-90 mW/m*K at 800° C.

10. The lamp of claim 1, wherein said rare gas is xenon provided at a cold pressure of 11-17 bar.

11. The lamp of claim 1, wherein said electrodes are made of tungsten.

12. The lamp of claim 1, wherein said electrodes are rod-shaped with a rod diameter of 280-320 μm.

13. The lamp of claim 1, wherein said metal halides further comprise at least $ZnI_2$, and wherein an amount of the $ZnI_2$ is 4-6 wt-% of said metal halide.

* * * * *